United States Patent [19]

Thivellier et al.

[11] 4,004,922

[45] Jan. 25, 1977

[54] FREE MACHINING STEEL

[75] Inventors: Daniel Thivellier, Faverges; Leon Séraphin, Ugine; Roland Tricot, Albertville, all of France

[73] Assignee: Ugine Aciers, Paris, France

[22] Filed: Sept. 3, 1975

[21] Appl. No.: 610,052

[30] Foreign Application Priority Data

Nov. 10, 1974 France ..... 74.35231

[52] U.S. Cl. ..... 75/123 AA; 75/123 G; 75/123 R; 75/126 G; 75/126 L; 75/126 M; 75/126 R; 75/128 P; 75/128 R

[51] Int. Cl.[2] ..... C22C 38/60

[58] Field of Search ..... 148/36; 75/123 R, 123 AA, 75/123 G, 126 R, 126 G, 126 L, 126 M, 128 R, 128 P

[56] References Cited

UNITED STATES PATENTS

| | | | |
|---|---|---|---|
| 3,192,040 | 6/1965 | Goda, Jr. et al. | 75/123 AA |
| 3,579,329 | 5/1971 | Mito et al. | 75/126 G |
| 3,634,074 | 1/1972 | Ito et al. | 75/126 M |

FOREIGN PATENTS OR APPLICATIONS

| | | | |
|---|---|---|---|
| 1,388,407 | 6/1965 | France | 75/123 R |
| 1,485,856 | 6/1967 | France | 75/123 R |

*Primary Examiner*—Arthur J. Steiner
*Attorney, Agent, or Firm*—Dennison, Dennison, Meserole & Pollack

[57] ABSTRACT

Free machining low alloy steel compositions are prepared by addition of very small quantities of at least magnesium to previously deoxidized steel to provide a homogeneous distribution of globular sulfides and sulfurous inclusions of the additive.

12 Claims, 2 Drawing Figures

FREE MACHINING STEEL

Figure 1:
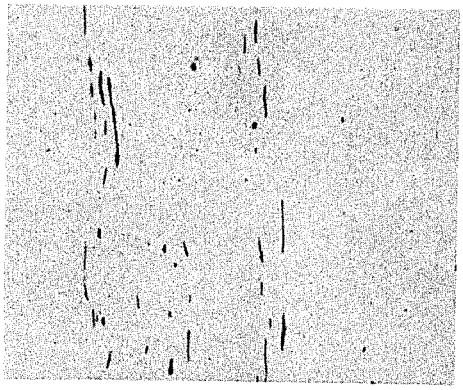

The present invention relates to free machining steels having greatly improved characteristics of resilience and ductility.

It is known that the addition of sulphur to a steel improves its suitability for free cutting, compared with the same steel containing no sulphur.

In the following text therefore the term "free machining steel" will be used to describe either a structural steel which is slightly alloyed and contains one or more alloy elements such as manganese, silicon, nickel, chrome, molybdenum, or vanadium, together with various usual impurities, or a stainless steel containing at least 10% of chrome and optionally other alloy elements such as nickel or molybdenum, these steels having a sulphur content of between 0.04 and 0.5%, intended to improve their suitability for machining in comparison with steels of the same composition which have a lower sulphur content.

In these free machining steels, the sulphur is present in the form of inclusions of manganese sulphide or other alloy elements. It is known that, if, in the course of the preparation of the steel, special precautions are not taken in respect of these inclusions, sulphides are obtained in the ingot which are situated in a preferential manner in the interdendtritic spaces and in addition these sulphides are malleable. The result is that in the rolled product they occur in a threadlike manner and are segregated in lines, which brings about a deterioration of the mechanical characteristics particularly in the crosswise direction, i.e. at right angles to the direction of rolling.

It is therefore important to control the nature and distribution of the sulphides to obtain globular and regularly distributed sulphides in the rolled metal. If this is so, the resilience and ductility in the crosswise direction are thereby improved.

It has been proposed, in order to achieve this result, to add to the steel metalloids of the sulphur family, such as selenium or tellurium, or rare earth metals such as cerium. These elements do in fact enable one to act upon the malleability of the sulphurous inclusions which remain globular after rolling, but they do however have certain disadvantages.

Firstly, in order to be effective, the elements must be added in relatively large quantities. It is considered that the following ratios of content by weight are necessary: Se/S of the order of 0.4, Te/S of the order of 0.2, or Ce/S of the order of 2. As these elements are fairly costly, the result is a sizeable increase in the manufacturing cost.

Secondly, these elements do not eliminate the segregation in the interdendritic spaces and in the rolled state it is not possible to avoid the presence of segrations into lines harmful to the mechanical characteristics in the crosswise direction.

It is also known that magnesium and the alkaline-earth metals, calcium, strontium and barium have a high reactivity to sulphur and that they have for a long time been used as desulphurising agents in the preparation of steel. When added in large quantities, they bring about the separation of the sulphides in the liquid metal and a rapid decantation which leads to the elimination of the sulphur.

The applicant has discovered however that when these elements are added in very small quantities after the deoxidation of the bath, they no longer behave as desulphurising agents but rather they remain in the sulphurous inclusions and permit the modification of the form and distribution thereof, thus removing the above mentioned disadvantages.

The invention therefore relates to free machining steels which by virtue of the homogeneous distribution of the globular, low-malleability sulphides, have greatly improved mechanical characteristics in the crosswise direction. It also relates to articles, objects and parts manufactured from these steels, and a process for the preparation of these same steels.

The free machining steels according to the invention, which have a sulphur content by weight of between 0.04 and 0.5% and greatly improved resilience and ductility in the crosswise direction, contain magnesium in a quantity which at most is equal to 0.005% (50 ppm) and at least equal to 5 thousandths of the sulphur content.

In fact, the presence of magnesium, calcium, strontium or barium in very small quantities produces the surprising result that the sulphides are no longer segregated in the interdendritic spaces, but that they are distributed homogeneously in the steel. In addition, these sulphides are less malleable which avoids their being elongated during rolling.

Of the group of four metals just mentioned, magnesium is the most effective and its use is preferable. Tests have shown that in order to be of use the magnesium content must be at least equal to 5 thousandths of the sulphur content. Conversely, if present in too great a quantity, the magnesium can form globular oxides which are harmful to the mechanical characteristics. It is recommended that .005% (50 ppm) is not exceeded.

In the steel according to the invention, the magnesium is present not only in the form of an oxide, but as a constituent element of the sulphides. This is only possible if it is added to a steel which has been previously deoxidised by the addition of a powerful deoxidising agent such as aluminium, stirring with a deoxidising slag vacuum deaeration or any other known deoxidation process.

Deoxidation is followed by the addition of sulphur to adjust the content of this element to the desired value. This addition can be effected by any appropriate means, for example according to the process described by French Pat. No. 1,597,415.

After deoxidation the magnesium is added by one of the conventional methods, e.g. Ni-Mg or Si-Ca-Mg alloy, in the furnace, in the ladle or in the ingot mould.

The steel according to the invention can contain in addition to magnesium one at least of the elements calcium, barium or strontium. These elements have an effect similar to that of magnesium and in addition, the effectiveness of the addition of magnesium is greatly improved in the presence of these elements. The use of the alloy Si-Ca-Mg which permits the introduction both of magnesium and calcium, is therefore of particular advantage. the Ca+Ba+Sr content of the steel should be between 0.001 and 0.005%.

The steel according to the invention may also contain selenium and/or tellurium of which the sulphide globulising effect is known, which enables one to combine the advantages of the two processes.

Thanks to the presence of the elements magnesium, calcium, strontium or barium, it is found that the additions of selenium and tellurium can be reduced in relation to what they would be without these elements, while maintaining their effectiveness in terms of globulising the sulphides. The content by weight of selenium is advantageously at least equal to 2 tenths of the sulphur content and at the most equal to 0.2%. The content by weight of tellurium is advantageously at least equal to 5 hundredths of the sulphur content and at the most equal to 0.04%. An excessively high tellurium content creates the risk of a deleterious effect on the forgeability of the metal. The introduction of the selenium and tellurium can be effected by any known method, in particular in the form of an iron or manganese alloy.

The improved free machining alloys according to the invention can thus have mechanical characteristics, particularly ductility and resilience in the cross wise direction, which are entirely comparable with those of non-reslphurated steels of the same grade. Moreover, it is found that resilience at low temperature is considerably better than that of the conventional steels, even having a low sulphur content.

The drawings demonstrate the globulising and dispersing effect of the additions according to the invention.

The invention will be understood better from the examples below which are only particular, non-limitative cases:

EXAMPLE 1

Structural steel, prepared in a high frequency furnace deoxidised with aluminium, resulphurated and having received an addition of magnesium, of which the composition by weight (in %) is as follows:

| | | | | | |
|---|---|---|---|---|---|
| C | 0.20 | Cr | 0.46 | Mg | 0.0035 |
| Si | 0.32 | Mo | 0.24 | Fe | remainder |
| Mn | 1.04 | S | 0.07 | | |
| Ni | 0.30 | Al | 0.025 | | |

By comparison with the same steel without magnesium, the following results are obtained in the KCU resilience test on distressed, tempered metal (R=1300N/mm²). The steels are hot worked with a reduction factor of 45.

Table I

| | With Mg | Without Mg |
|---|---|---|
| KCU lengthwise | 54 J/cm² | 53 J/cm² |
| KCU crosswise | 20 J/cm² | 14 J/cm² |
| lengthwise/crosswise ratio | 2.7 | 3.5 |

Table I shows the clear improvement of the crosswise resilience in the steel containing magnesium.

EXAMPLE 2

Structural steel, prepared in the high frequency furnace, deoxidised with aluminium, resulphurated and having received additions of magnesium and calcium, of which the composition by weight (in %) is as follows:

| | | | | | |
|---|---|---|---|---|---|
| C | 0.23 | Cr | 0.57 | Mg | 0.0030 |
| Si | 0.33 | Mo | 0.25 | Ca | 0.0015 |
| Mn | 1.48 | S | 0.06 | Fe | remainder |
| Ni | 0.64 | Al | 0.025 | | |

By comparison with the same steel including only an addition of magnesium (without calcium) and with the same steel with neither magnesium nor calcium, the following results are obtained in the transverse bending test and the transverse resilience test on tempered and annealed metal (R=850 N/mm²). The steel is hot worked with a reduction factor of 27.

Table II

| | With Mg+Ca | With Mg only | With neither Mg nor Ca |
|---|---|---|---|
| Angle of bending | 65° | 55° | 30° |
| Resilience | 26 J/cm² | 22 J/cm² | 12 J/cm² |

Table II shows the clear improvement of these two characteristics in the presence of magnesium and still more so in the presence of magnesium plus calcium.

EXAMPLE 3

Structural steel prepared in the high frequency furnace, deoxidised with aluminium, reslphurated and having received additions of magnesium and tellurium, of which the composition by weight (in %) is as follows:

| | | | | | |
|---|---|---|---|---|---|
| C | 0.18 | Cr | 0.51 | Ca | 0.0005 |
| Si | 0.18 | Mo | 0.23 | Mg | 0.0004 |
| Mn | 0.81 | S | 0.05 | Te | 0.0050 |
| Ni | 0.52 | Al | 0.03 | Fe | remainder |

By comparison with the same steel without the addition of tellurium alone and with the same steel with the addition of neither magnesium nor tellurium, the following results are obtained, under the same conditions as for example No. 2.

Table III

| | With Mg + Te | With Te only | With neither Mg nor Te |
|---|---|---|---|
| Angle of bending | 70° | 46° | 30° |
| Resilience | 32 J/cm² | 26 J/cm² | 12 J/cm² |

Table III shows the improvement in these two characteristics in the presence of tellurium. This improvement is still greater in the presence of tellurium plus magnesium.

EXAMPLE 4

Structural steel, prepared in a basic arc furnace, deoxidised with aluminium, resulphurated and having received additions of calcium, magnesium and tellurium, of which the composition by weight (in %) is as follows:

| | | | | | |
|---|---|---|---|---|---|
| C | 0.18 | Cr | 0.51 | Ca | 0.0005 |
| Si | 0.18 | Mo | 0.23 | Mg | 0.0004 |
| Mn | 0.81 | S | 0.05 | Te | 0.0050 |
| Ni | 0.52 | Al | 0.03 | Fe | remainder |

By comparison with the same steel without the addition of calcium, magnesium or tellurium, the following results are obtained in the KCU resilience test (tempered and distressed state, R = 1400 N/mm²).

Table IV

| | With Mg+Ca+Te | Without Mg, Ca or Te |
|---|---|---|
| Lengthwise resilience | 56 J/cm² | 51 J/cm² |
| Crosswise resilience | 20 J/cm² | 12 J/cm² |
| Lengthwise/crosswise ratio | 2.8 | 4.3 |

Table IV shows the clear improvement in the crosswise resilience of the steel containing magnesium, calcium and tellurium.

Moreover, the steel of example 4 with the addition of Mg, Ca and Te as well as the check steel without additions were subjected to two series of machinability tests. The first series of tests involved machining carried out on a lathe using a high speed steel tool of AFNOR grade 18–0–1 containing by weight W 18%, Cr 4% and V 1%. This tool had the following characteristics:

| | |
|---|---|
| -angle of grinding slope | 20° |
| -clearance angle | 8° |
| -cutting edge rake angle | 0° |
| -angle of tip | 70° |
| -angle of lead | 90° |
| -chamfer of nose | 0.3 mm |

It was used for dry machining cylinders of the steel of the examle with and without addition, parallel to the generatrix with a depth of pass of 2 mm and a lead of 0.25 mm per revolution. The test method and the method of calculating the results are set out in AFNOR draft reference standard BNS 1097. The results of this first test expresseed in compatible speed are given in table V and they show the optimum machinability using a high speed tool, of the steel with the addition of Mg+Ca+Te. A second series of tests was conducted using a P 30 type carbide tool with which cylinders of the steel of the example with and without additions were machined.

The machining was effected parallel to the generatrix with a depth of pass of 2 mm and a lead of 0.25 mm per revolution. The wear on the tool was measured after 32 mins of machining at a speed of 160 m/min. The results given in table V show a tool wear of more than 3 times less in the case of the steel including additions of Mg+Ca+Te.

Table V

| | With Mg+Ca+Te | Without Mg, Ca, or Te |
|---|---|---|
| Compatible speed | 65 m/min | 43.5 m/min |
| Tool wear | 0.095 mm | 0.32 mm |

EXAMPLE 5

Structural steel, prepared in a basic arc furnace, deoxidised with aluminium, resulphurated and having received additions of calcium, magnesium and tellurium, of which the composition by weight (in %) is as follows

| | | | | | |
|---|---|---|---|---|---|
| C | 0.17 | Cr | 1.00 | Ca | 0.0007 |
| Si | 0.32 | Mo | 0.02 | Mg | 0.0005 |
| Mn | 1.28 | S | 0.06 | Te | 0.0050 |
| Ni | 0.27 | Al | 0.03 | Fe | Remainder |

By comparison with the same steel without the addition of calcium, magnesium or tellurium, the following results are obtained in the KCU resilience test (tempered and distressed state, R = 1400 N/mm²). The steels are hot worked with a reduction factor of 20.

Table VI

| | With Mg+Ca+Te | Without Mg, Ca or Te |
|---|---|---|
| Lengthwise resilience | 48 J/cm² | 50 J/cm² |
| Crosswise resilience | 16 J/cm² | 9 J/cm² |
| Lengthwise/crosswise ratio | 3 | 5.5 |

Table VI shows the clear improvement in the crosswise resilience in the presence of magnesium, plus calcium, plus tellurium.

Figure 2:
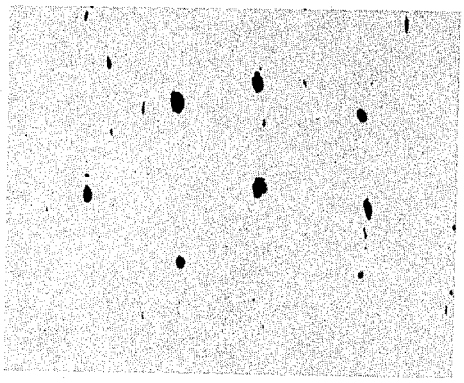

Samples were taken from these steels with and without additions and micrographic examinations were conducted. FIGS. 1 and 2 at 200× magnification give cross section views showing the form and distribution of the sulphides. FIG. 1 corresponds to the grade of example 5 without the addition of Mg, Ca and Te, while FIG. 2 corresponds to the same grade with the addition of Mg, Ca and Te. In FIG. 2 one can clearly see the globulising and dispersing effect of the additions according to the invention.

Furthermore, machining tests were conducted on these same steels under conditions similar to those described in example 4, but in the case of the carbide tool machining, the machining speed was adjusted to 250 m/min for an identical duration of 32 min. The results given in table VII show in accordance with the invention the better machinabiity of the grade including the additions of Mg+Ca+Te.

Table VII

| | With Mg+Ca+Te | Without Mg, Ca or Te |
|---|---|---|
| Compatible speed | 73.5 m/min | 66.5 m/min |
| Tool wear | 0.26 mm | 0.31 mm |

EXAMPLE 6

Austenitic stainless steel, resulphurated and having recieved additions of magnesium and tellurium, of which the composition by weight (in %) is as follows

| | | | | | |
|---|---|---|---|---|---|
| C | 0.06 | Cr | 17.8 | Te | 0.025 |
| Si | 0.43 | Mo | 0.05 | Fe | remainder |
| Mn | 1.4 | S | 0.25 | | |
| Ni | 8.3 | Mg | 0.0050 | | |

By comparison with the same steel with the addition of neither magnesium nor tellurium, the following results are obtained in the KCU resilience test at 20° C.

Table VIII

| | With Mg+Te | Without Mg or Te |
|---|---|---|
| Lengthwise resilience | 190 J/cm² | 180 J/cm² |
| Crosswise resilience | 110 J/cm² | 80 J/cm² |
| Lengthwise/crosswise ratio | 1.7 | 2.25 |

Table VIII shows the improvement in the crosswise resilience in the presence of magnesium plus tellurium.

EXAMPLE 7

Martensitic stainless steel, resulphurated and having received additions of magnesium and tellurium, of which the composition by weight (in %) is as follows:

| | | | | | |
|---|---|---|---|---|---|
| C | 0.07 | Cr | 13.3 | Te | 0.030 |
| Si | 0.30 | Mo | 0.22 | Fe | remainder |
| Mn | 1.1 | S | 0.31 | | |
| Ni | 0.14 | Mg | 0.0050 | | |

By comparison with the same steel without the addition of magnesium or tellurium, the following results are obtained in the KCU resilience test at 20° C.

Table IX

| | With Mg and Te | Without Mg or Te |
|---|---|---|
| Lengthwise resilience | 65 J/cm² | 60 J/cm² |
| Crosswise resilience | 18 J/cm² | 10 J/cm² |
| Lengthwise/crosswise ratio | 3.6 | 6 |

Table IX shows the improvement of the crosswise resilience in the presence of magnesium plus tellurium.

These examples show that the invention permits the production of steels of all types having both an increased suitability for machining and also considerably improved mechanical characteristics particularly with regard to resilience.

We claim:

1. A previously deoxidized, resulfurated free machining steel, having a homogeneous distribution of globular sulfides and sulfurous inclusions and having a sulfur content of about 0.04 and about 0.5% and having a greatly improved crosswise ductility and resilience, characterized in that it contains sulfur globularizing free magnesium in a quantity at the most equal to 0.005% and at the least equal to 5 thousandths of the sulfur content, said magnesium having been added to said steel subsequent to deoxidation.

2. A steel according to claim 1, characterised in that it contains in addition to magnesium one at lest of the elements Ca, Ba and Sr.

3. A steel according to claim 2, characterised in that the total content of calcium, barium, and strontium is between 0.001 and 0.005%.

4. A steel according to claim 1, characterised in that it contains in additon one at least of the two elements selenium and tellurium.

5. A steel according to claim 2, characterised in that it contains in addition one at least of the two elements selenium and tellurium.

6. A steel according to claim 3, characterised in that it contains in addition one at least of the two elements selenium and tellurium.

7. A steel according to claim 4, characterised in that the selenium content is at least equal to two tenths of the sulfur content and at the most equal to 0.02%.

8. A steel according to claim 5, characterised in that the selenium content is at least equal to two tenths of the sulfur content and at the most equal to 0.2%.

9. A steel according to claim 6, characterised in that the selenium content is at least equal to two tenths of the sulfur content and at the most equal to 0.2%.

10. A steel according to claim 4, characterised in that the tellurium content is at least equal to five hundredths of the sulfur content and at the most equal to 0.04%.

11. A steel according to claim 4, characterised in that the tellurium content is at least equal to five hundredths of the sulfur content and at the most equal to 0.04%.

12. A steel according to claim 6, characterised in that the tellurium content is at least equal to five hundredths of the sulfur content and at the most equal to 0.04%.

* * * * *